US006964619B1

(12) United States Patent
Mejia

(10) Patent No.: US 6,964,619 B1
(45) Date of Patent: Nov. 15, 2005

(54) COMBINATION PUTTER AND DIVOT REPAIR DEVICE

(76) Inventor: Luis R. Mejia, 211 W. Valencia St., Brea, CA (US) 92821

( * ) Notice: Subject to any disclaimer, the term of this patent is extended or adjusted under 35 U.S.C. 154(b) by 0 days.

(21) Appl. No.: 10/846,697

(22) Filed: May 17, 2004

(51) Int. Cl.[7] ..... A63B 53/04
(52) U.S. Cl. ..... 473/286; 473/340; 473/408
(58) Field of Search ..... 473/286, 408, 473/340–341; D21/793

(56) References Cited

U.S. PATENT DOCUMENTS 3,185,483 A 5/1965 Klynman
4,951,951 A * 8/1990 Meyer ..... 473/286
6,095,935 A 8/2000 Gooselaw et al.
6,176,792 B1 1/2001 Tate
6,270,424 B1 8/2001 Holub
6,517,445 B1 * 2/2003 O'Neill ..... 473/226

* cited by examiner

*Primary Examiner*—Stephen Blau

(57) ABSTRACT

A combination putter and divot repair device includes an elongated shaft, a club head connected thereto. The front portion of the club head has a substantially flat surface for striking a golf ball. The rear portion of the club head defines a lip portion and further has a generally arcuate portion extending vertically from the lip portion. The device further includes a mechanism for repairing a golf ball divot, which is adjustably connected to the club head wherein the club head has a slot formed for allowing the repairing mechanism to pass therethrough. The repairing mechanism includes a tool member pivotally connected to the lip portion of the club head and movable between extended and retracted positions.

16 Claims, 3 Drawing Sheets

COMBINATION PUTTER AND DIVOT REPAIR DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to golfing accessories and, more particularly, to a combination putter and divot repair device.

2. Prior Art

Golf is one of the most popular sports in the world. It appeals to many because it is played in a restful atmosphere and provides a healthy activity that is not rigorous or conducive to athletic injuries as are many other sports. As such, numerous golf courses can be found in virtually all industrialized countries.

A golf course occupies a large area of land, in typically providing at least one full course of 18 "holes". Each hole consists of a tee from which golfers start play on the hole, a "fairway" along which the grass has been cut to provide a fair lie for the golf ball and which may include natural or artificial hazards such as sand traps and/or water hazards, and a "putting green" which consists of a patch of finely cut grass surrounding a cup, which according to the objects of golf is the target into which the golfer tries to place the ball using as few strokes as possible.

Golf has rigid rules and standards, and golf courses tend to be carefully maintained in accordance with those rules and standards. Fairways are kept evenly trimmed and hazards are kept well defined. However, much of the effort and expense of maintaining a golf course is spent on the putting greens in particular, which must be finely trimmed and maintained in meticulous condition.

The putting greens are distinct from the rest of the golf course in other respects, being the one area of the golf course at which a golfer is permitted to pick up his or her golf ball for cleaning and the only part of the hole on which the golfer uses a putter. These features and the fine cut of the grass on the putting green are intended to reduce as much as possible obstacles to putting the golf ball into the cup, so that the golfer's so-called "short game" is almost entirely reliant upon the skill of the golfer and is relatively uninfluenced by extraneous factors such as uneven ground or other obstacles.

A certain degree of deterioration of the golf course results from the play of successive rounds of golf, as golfers dig divots out of the fairways with their golf clubs and leave ball marks on the finely trimmed putting greens where golf balls land and bounce to a rest position. With a view to maintaining the golf course in good condition, golfers are expected to replace their divots and to repair ball marks left on a putting green. The putting green in particular, being a relatively confined space that experiences a high concentration of activity, is especially difficult to maintain during a busy golf day. Thus, the continuing repair of ball marks is very important to the enjoyment of the game of golf by successive golfers over the course of a day.

However, the proper repair of ball marks on a putting green requires a special tool that will not damage the underlying ground or remove grass, and golfers frequently find themselves on the green without such a tool immediately available.

Furthermore, golf is a game that requires intense concentration, and frequently golfers are too involved in the game, particularly at the putting green, to remember either to repair their ball marks or to bring or use a tool suitable for properly repairing ball marks to the putting green (particularly given that the ball mark is usually located some distance from where the golf ball actually comes to rest on the putting green). Any ball mark repair tool must be compact and convenient to use, and must not interfere with the normal routines of the golfer or the other equipment used by the golfer during a game of golf, or the golfer will not use it.

For example, a ball mark repair tool may be carried in a golfer's golf bag or pocket, but is easily forgotten because it is out of sight when the ball mark must be repaired. Golfers tend to carry a damp towel in their golf bag for cleaning the golf ball on the putting green, but this is generally inconvenient since the golf bag is not brought onto the putting green and is therefore not immediately accessible when the golfer needs to clean his or her ball.

It would accordingly be advantageous to provide a compact tool which can be used by a golfer on the putting green to repair ball marks, which is immediately accessible to the golfer but does not interfere with the play or equipment used by the golfer. Since the one item that a golfer always brings to the putting green is his or her putter, a repair tool incorporated into the design of a putter would make it convenient for a golfer to repair ball marks and divots.

BRIEF SUMMARY OF THE INVENTION

In view of the foregoing background, it is therefore an object of the present invention to provide a combination putter and divot repair device. These and other objects, features, and advantages of the invention are provided by a device including an elongated shaft having a centrally disposed longitudinal axis and further having opposed end portions. The device further includes a grip portion formed from rubber material for being grasped by a user and for assisting a user to maintain control of the device. The grip portion is disposed about one end portion of the elongated shaft and is integral therewith.

A club head having front and rear portions is connected to another end portion of the elongated shaft and extends substantially orthogonally therefrom. The front portion of the club head has a substantially flat surface for striking a golf ball. The rear portion of the club head defines a lip portion and further has a generally arcuate portion extending vertically from the lip portion and being integral therewith. The club head further has distal and proximal portions.

The device further includes a mechanism for repairing a golf ball divot. The mechanism is adjustably connected to the club head wherein the club head has a slot formed at the distal portion thereof for allowing the repairing mechanism to pass therethrough during operating conditions. The repairing mechanism includes a tool member having a generally staple shape pivotally connected to the lip portion of the club head and movable between extended and retracted positions.

The repairing mechanism further includes a fastening member attached to the lip portion of the club head about which the tool member pivots along a select arcuate path.

The tool member preferably includes a pair of spaced appendages engageable with a ground surface for repairing divots formed therein during operating conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
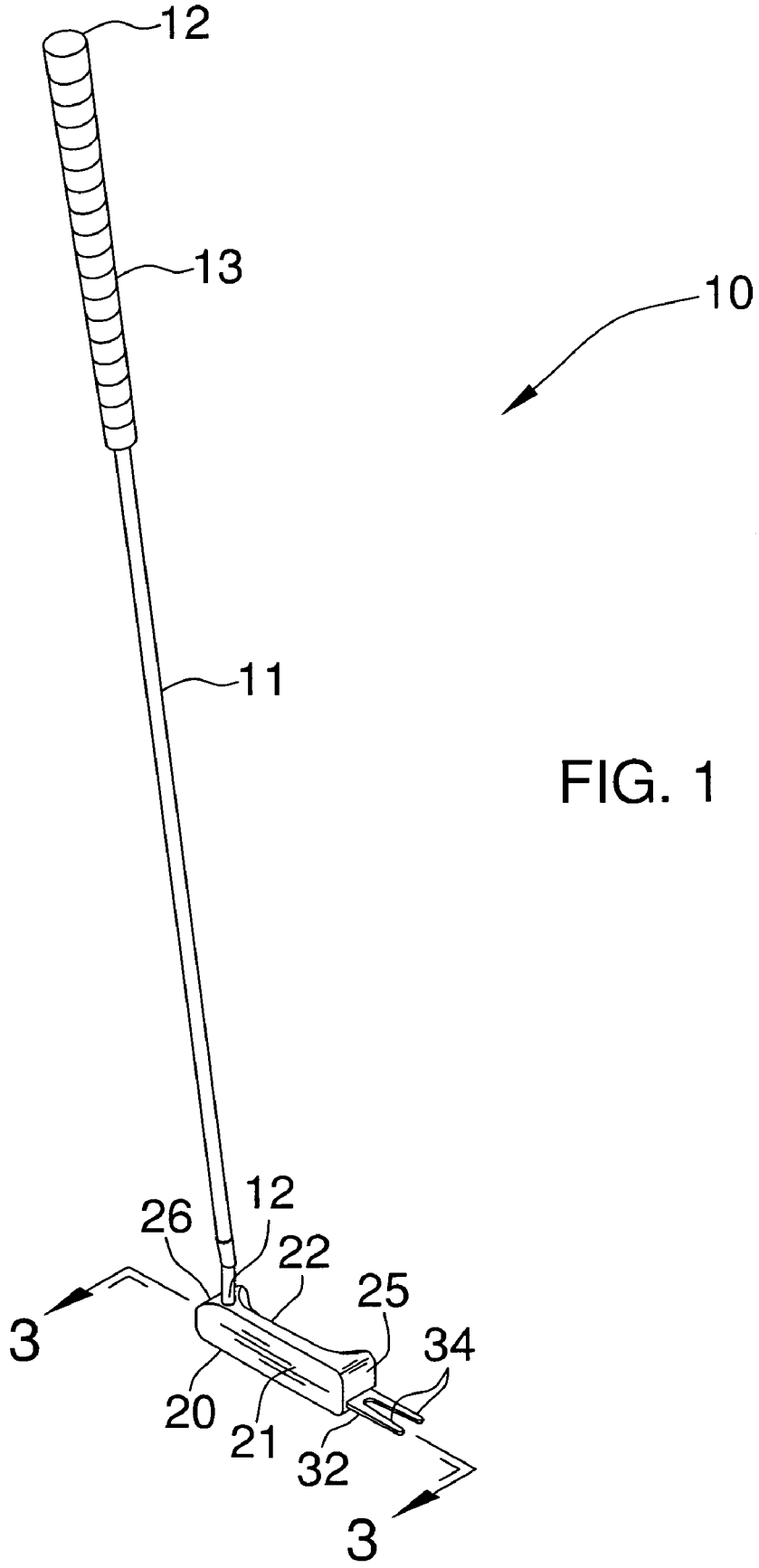
FIG. 1 is a perspective view showing a combination putter and divot repair device, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–4 by the reference numeral 10 and is intended to provide a combination putter and divot repair device. It should be understood that the device 10 may be used to repair many different types of ground impairments and should not be limited to repairing only divots caused by the impact of a golf ball.

Initially referring to FIG. 1, the device 10 includes an elongated shaft 11 having a centrally disposed longitudinal axis (not shown) and further having opposed end portions 12. The device further includes a grip portion 13 formed from rubber material for being grasped by a user and for assisting a user to maintain control of the device 10. The grip portion 13 enables a golfer to maintain his/her grip at all times, in all weather conditions. The grip portion 13 is disposed about one of the end portions 12 of the elongated shaft 11 and is integral therewith.

Figure 2:
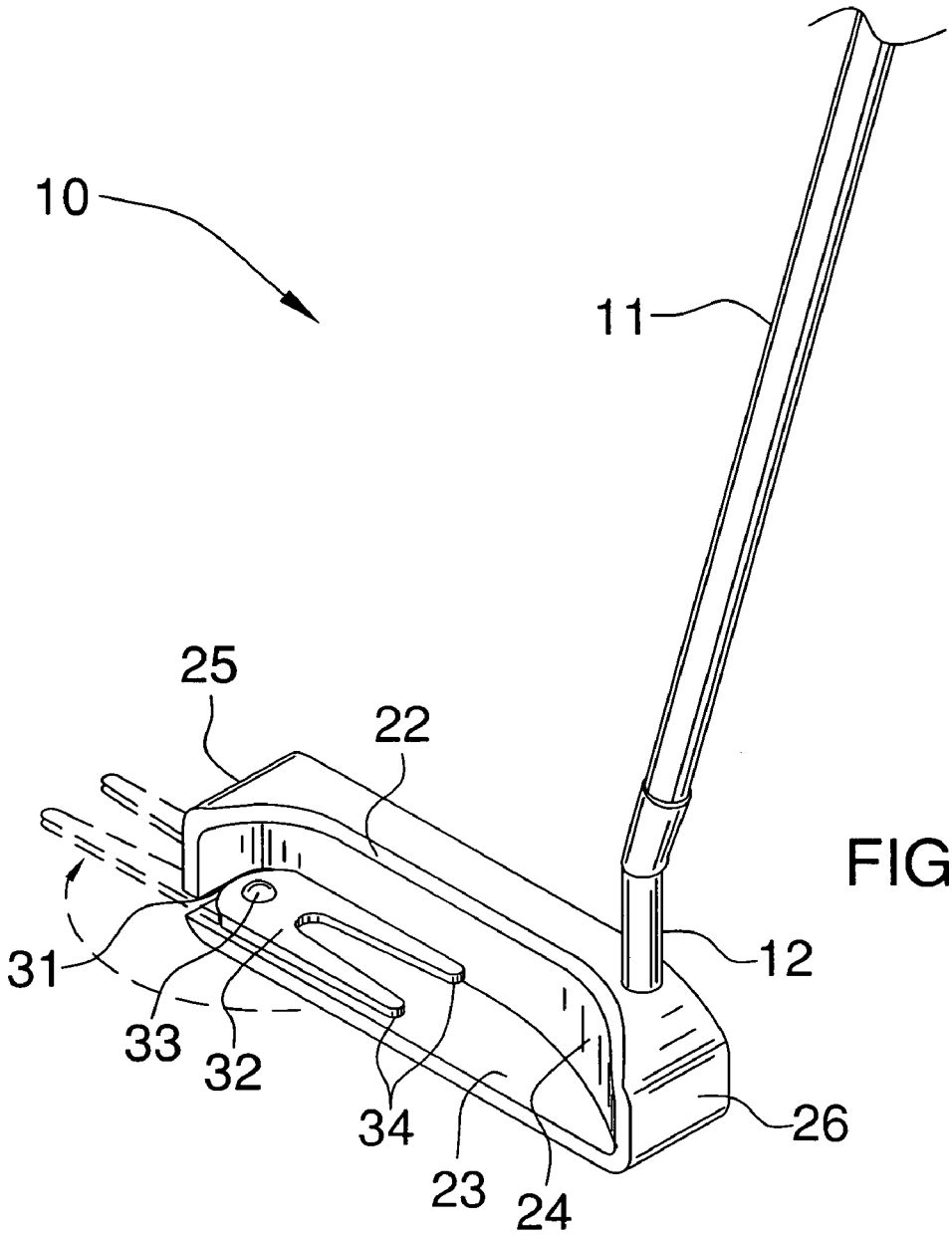
FIG. 2 is an enlarged perspective view of the club head illustrating the pivoting movement of the repairing mechanism.
Figure 3:
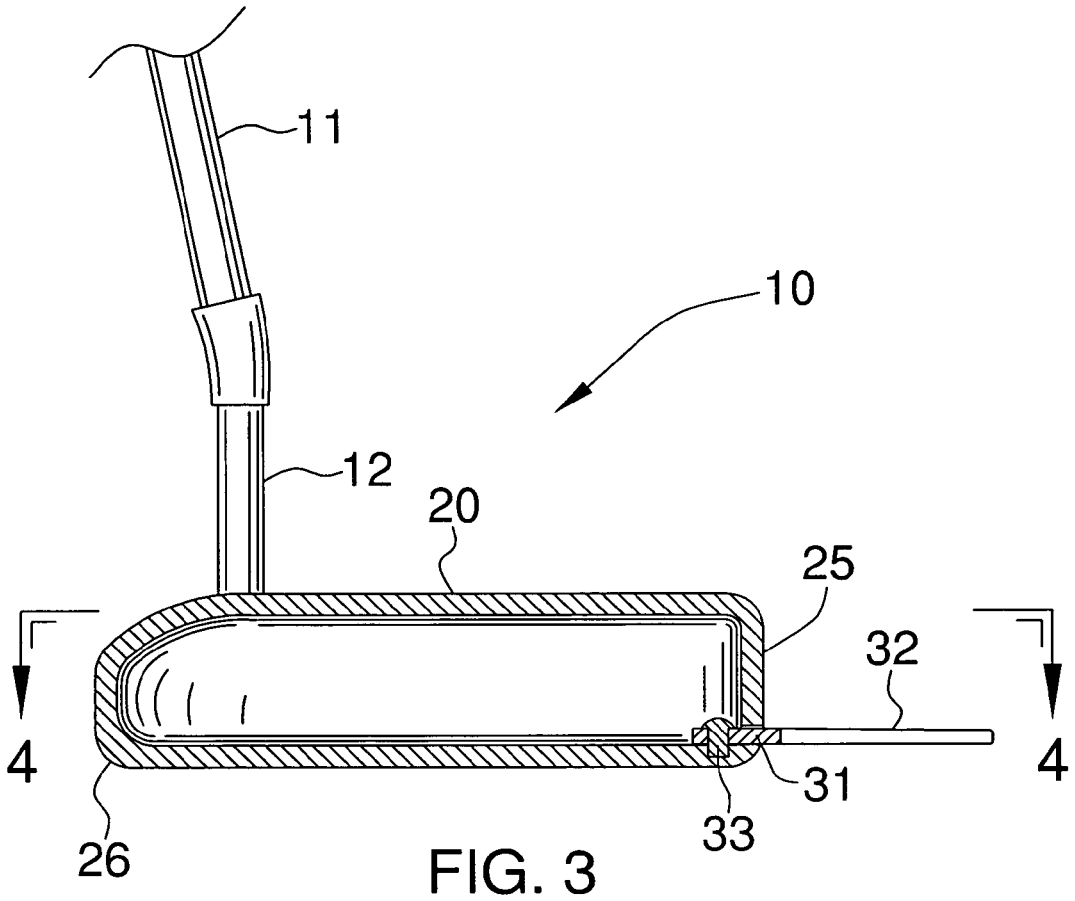
FIG. 3 is a cross-sectional view of the club head with the tool member at an extended position, taken along line 3—3.
Figure 4:
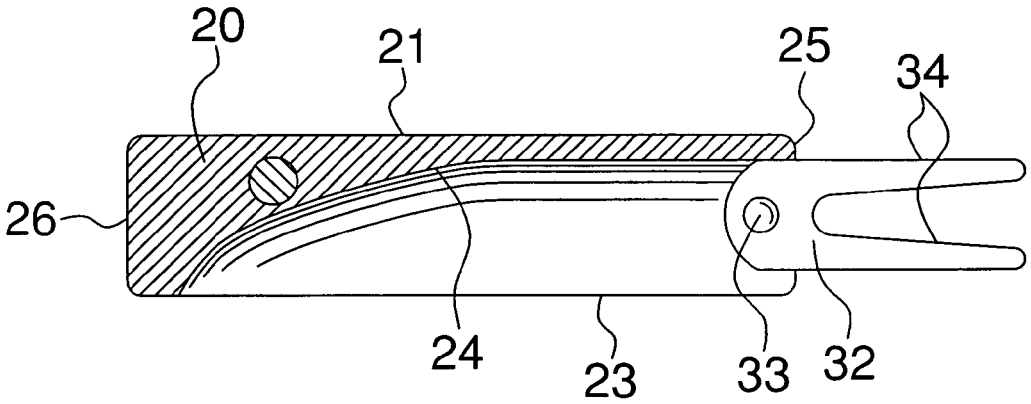
FIG. 4 is a cross-sectional view of the club head and repair mechanism, taken along line 4—4.

Now referring to FIG. 2, a club head 20 having front 21 and rear 22 portions is connected to another of the end portions 12 of the elongated shaft 11 and extends substantially orthogonally therefrom. The front portion 21 of the club head 20 has a substantially flat surface for striking a golf ball. The rear portion 22 of the club head 20 defines a lip portion 23 and further has a generally arcuate portion 24 extending vertically from the lip portion 23 and being integral therewith. The club head 20 further has distal 25 and proximal 26 portions and may be produced in a variety of different shapes and configurations.

Still referring to FIG. 2, the device 10 further includes a mechanism 30 for repairing a golf ball divot adjustably connected to the club head 20 wherein the club head 20 has a slot 31 formed at the distal portion 25 thereof for allowing the repairing mechanism 30 to pass therethrough during operating conditions. Now referring to FIGS. 3 and 4, the repairing mechanism 30 includes a tool member 32 having a generally staple shape pivotally connected to the lip portion 23 of the club head 20 and movable between extended and retracted positions.

The repairing mechanism 30 further includes a fastening member 33 attached to the lip portion 23 of the club head 20 about which the tool member 32 pivots along a select arcuate path, as shown in FIG. 2. This enables the tool member 32 to be hidden from sight while the device 10 is being used as a conventional putter. The tool member 32 includes a pair of spaced appendages 34 engageable with a ground surface for repairing divots formed therein during operating conditions. Of course, tool member 32 may have other conventional shapes suitable for its intended application.

The device 10 provides a golfer with two useful items in one unit and eliminates the need for a golfer to bend over while repairing divots or ball marks. This reduces stress and strain on a user's back and joints, making the game more enjoyable and allowing a user to concentrate on the game. The device 10 can be used to repair ball marks on a green as well as divots in a fairway.

Because the divot repair tool is incorporated into a putter, the device 10 would be stored in a golfer's bag with a golfer's other clubs. This ensures that the device 10 is easy to access and readily available when needed and eliminates the need to search the pouches and pockets of a golf bag in order to locate a divot repair tool, saving time and aggravation. The device 10 also eliminates the need to keep a divot repair tool in a pants pocket, which can soil a golfer's pants or punch holes in the pocket.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combination putter and divot repair device, said device comprising:

an elongated shaft having a centrally disposed longitudinal axis and opposed end portions;

a grip portion for being grasped by a user, said grip portion being disposed about one said end portion of said elongated shaft and being integral therewith;

a club head having front and rear portions, said club head being connected to another said end portion of said elongated shaft and extending substantially orthogonally therefrom, said rear portion of said club head defining a lip portion and further having a generally arcuate portion extending vertically from said lip portion and being integral therewith, said club head further having distal and proximal portions; and means for repairing a golf ball divot and being adjustably connected to said club head wherein said club head has a slot formed at said distal portion thereof for allowing said repairing means to pass therethrough during operating conditions wherein said repairing means stays attached to said head during divot repair using said repairing means.

2. The device of claim 1, wherein said grip portion is formed from rubber material for assisting a user to maintain control of said device.

3. The device of claim 1, wherein said front portion of said club head has a substantially flat surface for striking a golf ball.

4. The device of claim 1, wherein said repairing means comprises:

a tool member pivotally connected to said lip portion of said club head and being movable between extended and retracted positions.

5. The device of claim 1, wherein said repairing means further comprises:

a fastening member attached to said lip portion of said club head about which said tool member pivots along a select arcuate path.

6. The device of claim 1, wherein said tool member has a generally staple shape.

7. The device of claim 1, wherein said tool member comprises: a pair of spaced appendages engageable with a ground surface for repairing divots formed therein during operating conditions.

8. A combination putter and divot repair device, said device comprising:

an elongated shaft having a centrally disposed longitudinal axis and further having opposed end portions;

a grip portion formed from rubber material for being grasped by a user, said grip portion being disposed about one said end portion of said elongated shaft and being integral therewith;

a club head having front and rear portions, said club head being connected to another said end portion of said elongated shaft and extending substantially orthogonally therefrom, said rear portion of said club head defining a lip portion and further having a generally arcuate portion extending vertically from said lip portion and being integral therewith, said club head further having distal and proximal portions; and means for repairing a golf ball divot and being adjustably connected to said club head wherein said club head has a slot formed at said distal portion thereof for allowing said repairing means to pass therethrough during operating conditions wherein said repairing means stays attached to said head during divot repair using said repairing means.

9. The device of claim 8, wherein said front portion of said club head has a substantially flat surface for striking a golf ball.

10. The device of claim 8, wherein said repairing means comprises:

a tool member pivotally connected to said lip portion of said club head and being movable between extended and retracted positions; and a fastening member attached to said lip portion of said club head about which said tool member pivots along a select arcuate path.

11. The device of claim 8, wherein said tool member has a generally staple shape.

12. The device of claim 8, wherein said tool member comprises: a pair of spaced appendages engageable with a ground surface for repairing divots formed therein during operating conditions.

13. A combination putter and divot repair device, said device comprising:

an elongated shaft having a centrally disposed longitudinal axis and further having opposed end portions;

a grip portion formed from rubber material for being grasped by a user, said grip portion being disposed about one said end portion of said elongated shaft and being integral therewith;

a club head having front and rear portions, said club head being connected to another said end portion of said elongated shaft and extending substantially orthogonally therefrom, said rear portion of said club head defining a lip portion and further having a generally arcuate portion extending vertically from said lip portion and being integral therewith, said club head further having distal and proximal portions, said front portion of said club head having a substantially flat surface for striking a golf ball; and means for repairing a golf ball divot and being adjustably connected to said club head wherein said club head has a slot formed at said distal portion thereof for allowing said repairing means to pass therethrough during operating conditions wherein said repairing means stays attached to said head during divot repair using said repairing means.

14. The device of claim 13, wherein said repairing means comprises:

a tool member pivotally connected to said lip portion of said club head and being movable between extended and retracted positions; and a fastening member attached to said lip portion of said club head about which said tool member pivots along a select arcuate path.

15. The device of claim 13, wherein said tool member has a generally staple shape.

16. The device of claim 13, wherein said tool member comprises: a pair of spaced appendages engageable with a ground surface for repairing divots formed therein during operating conditions.

* * * * *